United States Patent [19]

Comolli

[11] 4,249,909

[45] Feb. 10, 1981

[54] DRYING AND PASSIVATING WET COALS AND LIGNITE

[75] Inventor: Alfred G. Comolli, Yardley, Pa.

[73] Assignee: Hydrocarbon Research, Inc., Lawrenceville, N.J.

[21] Appl. No.: 43,857

[22] Filed: May 30, 1979

[51] Int. Cl.[3] ..... C10L 9/08; F26B 3/00

[52] U.S. Cl. ..... 44/1 G; 44/1 R; 34/15; 34/26

[58] Field of Search ..... 44/1 R, 1 G, 10 E, 10 J; 34/15, 37, 26

[56] References Cited

U.S. PATENT DOCUMENTS

| | | | |
|---|---|---|---|
| 1,577,902 | 3/1926 | Fernholtz | 44/10 J |
| 1,600,065 | 9/1926 | Plochmann | 44/10 J |
| 1,632,829 | 6/1927 | Fleissner | 34/15 |
| 2,183,924 | 12/1939 | Schoch | 44/1 G |
| 3,985,516 | 10/1976 | Johnson et al. | 44/1 R |

*Primary Examiner*—Carl F. Dees
*Attorney, Agent, or Firm*—Michael A. Jacobs

[57] ABSTRACT

This invention discloses a staged process for drying wet carbonaceous materials such as sub-bituminous coal or lignite containing at least about 10 weight percent moisture, usually 15–50 weight percent moisture, by first heating the wet material under low partial pressure of moisture to permit the controlled rapid escape of surface moisture down to a critical moisture content of 8–12 weight percent. In a second step, the material is further heated at lower differential vapor pressure to provide for further moisture evolution at a slower controlled rate. This staged drying procedure permits wicking up of hydrocarbons contained in the coal to seal the surface of the dried coal product sufficient to prevent appreciable reabsorption of moisture and consequent heating and spontaneous ignition.

10 Claims, 3 Drawing Figures

FIG. 1
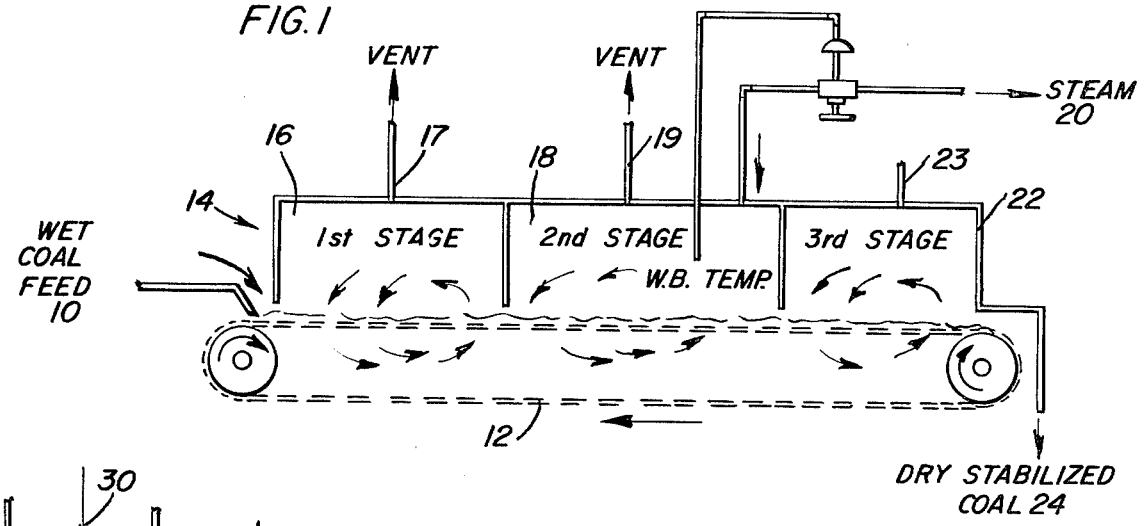
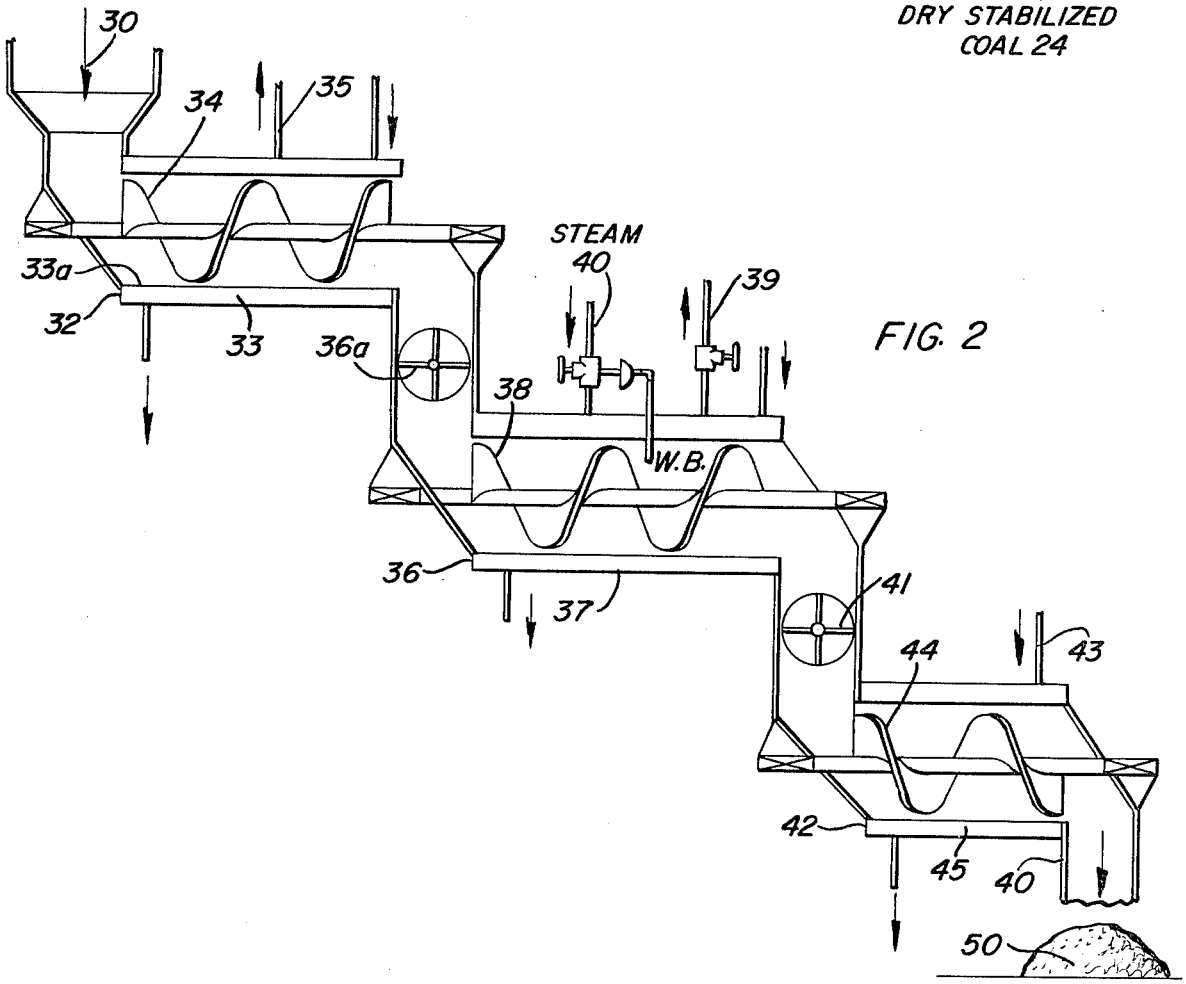
FIG. 2

MOISTURE IN COAL - INT. PERCENT
28
26
24
22
20
18
16
14
12
10
8
6
4
2
0
FREE OR SURFACE MOISTURE RANGE
BOUND MOISTURE RANGE
COAL CRITICAL MOISTURE CONTENT RANGE
USUAL COAL PARTICLE SURFACE RUPTURE MOISTURE RANGE
0
0.5
1
1.5
2
2.5
3
DRYING TIME - HRS.

DRYING AND PASSIVATING WET COALS AND LIGNITE

BACKGROUND OF THE INVENTION

1. Field of the Invention

This invention pertains to drying wet carbonaceous material such as coal and/or lignite so as to passivate it and prevent significant reabsorption of atmospheric moisture and consequent reheating of the material. It pertains more particularly to drying such materials at slow controlled rate below a critical moisture level, so that internal moisture is removed slowly to avoid particle rupture and the particle surface pores are substantially self-sealed by hydrocarbon material evolved from the particles.

2. Description of Prior Art

Low rank coals such as sub-bituminous or lignite contain more than about 10% moisture and usually 15–50 weight percent moisture. Such wet coals cannot be shipped economically over great distances due to the large water weight penalty and/or be burned efficiently due to the significant negative heating value of the water. However, drying such materials prior to shipment and/or storage usually leads to substantial reabsorption of atmospheric moisture and consequential reheating of the coal, which makes it subject to spontaneous ignition either during shipment or subsequent storage.

In the past, wet coals such as from western United States and lignite have been dried and then coated with carbonaceous materials such as heavy oil and tars to retard or prevent the reabsorption of moisture and possible reheating and autoignition. Examples of such coating processes are U.S. Pat. Nos. 3,985,516 and 3,985,517 to Johnson, which disclose heating and intimate mixing of coal with heavy oils to coat the particles. Although such coating procedures are rather effective in preventing reabsorption of moisture by the dried coal, such oil coating of dried coal and lignite is expensive due to the cost of the hydrocarbon materials added and thus is unattractive. It would be advantageous to dry wet coals in such a way that the coal particle pores are made self-sealing after moisture removal, so as to prevent the reabsorption of moisture without the need for externally supplied coating materials.

U.S. Pat. No. 1,632,829 to Fleissner discloses a process for drying wet coal by steam heating it using a procedure wherein steam provided above the coal is maintained at high partial pressure such that moisture will not escape during coal heat up, then reducing the steam pressure to permit the escape of moisture and rapid drying of the coal. Also, U.S. Pat. No. 4,052,169 to Koppelman discloses a process for upgrading lignitic coal, comprising heating it in an autoclave at about 750° F. temperature and 1000 psig or more pressure to effect a thermal restructuring, followed by cooling and depositing condensible organic material on the lignite to provide a stabilization of the upgraded product and render it nonhydroscopic and more resistant to weathering and oxidation during shipment and storage. In contrast, the present invention achieves rapid removal of surface moisture from the coal during its initial low pressure heating, and later permits the inner bound moisture to escape at a controlled slow rate so as to prevent surface rupture of the coal, thus permitting self-sealing of the particle surface by internal hydrocarbon material which is wicked up to the surface.

SUMMARY OF THE INVENTION

This invention discloses a method for drying wet carbonaceous material, such as particulate coals and lignite containing at least about 10 weight percent moisture and usually from about 15 to 50 weight percent moisture, in such manner that the material is passivated and substantial reaborption of moisture by the coal is precluded, but without the need for coating the dried material particles with an externally provided hydrocarbon material. This drying is accomplished by controlling the vapor pressure differential between the moisture in the carbonaceous material and that in the drying gas atmosphere used during a staged drying process. Such controlled rate drying is provided by a first step of rapid drying the material to remove surface moisture, followed by a second slower drying rate step. This results in the evolution or wicking up of low volatility hydrocarbons and resins contained in the coal or lignite to the surface of the particles by capillary flow during the slower drying step, whereby occluding the pores and substantially preventing absorption of moisture during subsequent coal shipment and/or storage.

This coal or lignite drying method is most economically and preferably carried out in two steps, with the drying or moisture removal rate used in the first step exceeding that in the second step. In the first step, the coal having particle size smaller than about 0.250 inch is heated to at least about 150° F. at atmospheric pressure using relatively dry gas, preferably air, and the free or surface moisture present in the coal is removed rapidly during an initial substantially constant rate phase of the drying cycle down to a critical moisture content or range, such as 8 to 12 weight percent moisture remaining in the coal. Control of the moisture partial pressure differential between the solids interface and the drying gas becomes necessary below this critical moisture range of the coal, when the bound moisture must be removed at a slower drying rate in a second step of drying. Such control of the wet bulb temperature and humidity of the surrounding gas atmosphere so as to reduce the water partial pressure differential below about 8 psi during the second stage drying prevents rapid moisture evolution and undesirable rupture of the coal particle surface due to rapid escape of the internal or bound water vapor. This also permits a gradual wicking up of internal hydrocarbons and resins contained in the coal to the particle surface to directly coat and substantially seal the pores during subsequent cooling of the coal to ambient conditions. In contrast, the prior use of a high moisture partial pressure differential during the entire drying process leads to a rapid vaporization and eruption of the bound water vapor from the particle surface, thus resulting in a highly porous structure of coal or lignite particle which prevents such self-sealing of the particle surface. Instead, the highly porous surface structure enhances the reabsorption of atmospheric moisture and possible spontaneous ignition of the coal, and is thus undesirable.

The general equation expressing the parameters affecting the rate of mass transfer of water from the coal particles during drying is as follows:

$$Wa = K_G A\ (Pi - Pa)$$

where:

Wa = rate of moisture evaporation from coal $K_G$ = mass transfer coefficient

A = area of particle wetted surface contacted by drying fluid

Pi = partial pressure of water vapor at coal particle interface

Pa = partial pressure of water vapor in drying gas stream

It is thus apparent that lowering the water partial pressure differential between the coal particle surface and the drying gas stream decreases the driving force for drying the coal, and provides a lower rate of water removal from the coal. Removal of bound or contained moisture at lower drying rates in accordance with this invention promotes the desired wicking of the hydrocarbons and resins contained in the coal particles to the surface, thereby preventing undesirable surface eruptions and resulting in a substantially sealed particle surface which is substantially impervious to the subsequent reabsorption of water vapor, resultant reheating, and possibly spontaneous ignition. A dried and passivated or stabilized coal or lignite product is thus provided, which can be shipped and/or stored for several weeks or even months without appreciable reabsorption of moisture and heating.

The drying process may be performed at atmospheric pressure or at elevated pressures as required to suit the type of carbonaceous material being dried and the heating method used. The second stage drying step is performed at increased temperature and usually at increased pressure conditions relative to the first stage conditions, so as to provide lower water vapor differential pressure between the drying gas and the coal and preferably less than about 8 psi.

The drying method of this invention can be accomplished either in (a) batch-wise manner such as in a heated oven or fluidized bed in which conditions are changed successively, or (b) continuously be mechanically moving the material through at least two successive drying steps, such as by a moving belt or screw conveyor. A continuous drying procedure is preferred for large capacity commercial drying applications for coal or lignite, such as those exceeding about 500 tons/-day.

DESCRIPTION OF THE DRAWINGS

FIG. 1 shows a diagram of a staged coal drying process wherein coal is moved through the drying stages by conveyor belt means.

FIG. 2 shows a diagram of a modified coal drying process in which coal is moved through each stage by screw conveyor means.

DESCRIPTION OF PREFERRED EMBODIMENTS

Figure 3:
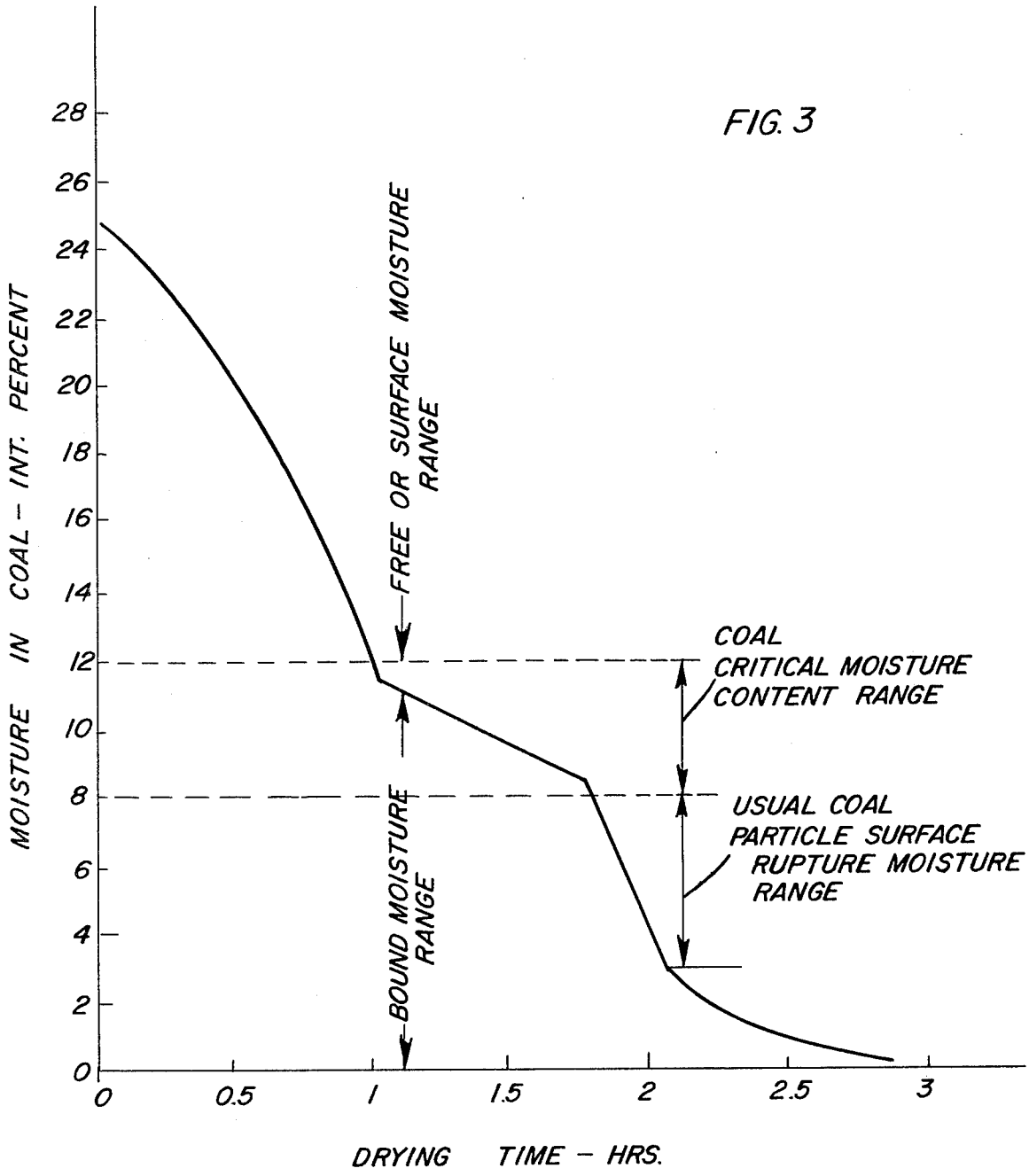
FIG. 3 is a representative drying curve obtained for lignite which shows the critical moisture content range.

Referring to FIG. 1 as an example of staged drying process, coal or lignite, containing at least about 10 weight percent moisture and usually 15–50 weight percent moisture, is provided at 10 and deposited on moving belt 12 and is conveyed into staged conveyor type dryer 14. In the first stage 16, removal of surface moisture from the coal is accomplished rapidly with, for example, circulating moist air at atmospheric pressure and at about 220° F. dry bulb temperature and 130° F. wet bulb temperature. Excess water vapor is removed at vent 17 to maintain the desired drying conditions within compartment 16 and to remove surface moisture down to a critical moisture range, such as 8–11 weight percent moisture in the coal.

The partially dried coal is then conveyed on into second stage 18, where the wet bulb temperature of the circulating air is controlled at a higher temperature of about 160° F. by steam supplied at 20 to provide a more humid environment, so as to provide therein a lower water partial pressure differential relative to that of the coal. This more humid condition results in slow removal of additional moisture from the coal particles, so that not only is particle rupture prevented but also low volatility hydrocarbons and tars contained in the coal are wicked to the surface where they serve to substantially seal the pores. The resulting dried and passivated coal, usually containing 3–6 weight percent moisture, is then passed on to a third stage at 22, where some air cooling of the coal occurs. The dry, passivated and stabilized coal product is collected at 24 for shipment and/or storage as desired.

As an alternative, this coal drying process can be performed by moving the wet particulate coal through the staged heating and drying steps by means of a screw conveyor, as generally shown in FIG. 2. The coal heating can be at least partially accomphished indirectly by heat exchange with heated walls or jackets. The wet particulate coal at 30 is introduced into the first stage drying zone 32 and is moved past heated jacket surface 33*a* by screw conveyor 34. The coal is heated at substantially atmospheric pressure by a hot circulating fluid such as steam in jacket 33 to 180°–300° F. temperature, resulting in rapid removal of surface moisture from the coal through vent 35 to a critical moisture range, such as 8–12 weight percent moisture.

Following first stage surface drying of the coal at 32 the partially dried coal is passed to a second drying stage 36, usually through a pressure lock device such as a rotary feeder 36*a*. This second stage is maintained at total pressure of 0.5 to 100 psig and the coal is moved by screw conveyor 38 and is heated by contact with jacket 37, which is heated by a hot circulating fluid to 200°–500° F. Steam can be added as needed at 40, and the coal is further dried at a slower rate of moisture removal to below the critical moisture content of 8–12 weight percent, and moisture is removed through controlled vent 39. Such slower drying rate in compartment 36 serves to remove the bound or contained moisture from within the coal particles so as to permit self-sealing of the coal particle surface pores with evolved internal hydrocarbon material such as tars and/or resins.

Following drying in the second stage 36, the coal is passed through rotary pressure lock 41 to a third stage 42 where it is moved by conveyor 44 and cooled to near ambient temperature, such as by air or water 43 circulated through jacket 45. The resulting dried and passivated coal or lignite product is then removed at 46 and passed to shipping or storage at 50.

Other methods of heat transfer between the wet coal particles and a heating gas may be used, such as a fluidized bed in which the particles are gently fluidized by the hot drying gas under appropriate humidity conditions in accordance with this invention, so as to minimize or avoid particle breakage.

This invention will be further illustrated by reference to the following examples of drying lignite and coal so as to passivate it and prevent significant reabsorption of atmospheric moisture. These examples are intended to be illustrative only and should not be construed to be limiting in scope of the invention.

EXAMPLE 1

Samples of North Dakota lignite having analysis as defined in Table 1 were dried in an electrically heated batch type oven at 250° F. at constant air circulation and vent rates.

TABLE 1

| PROXIMATE ANALYSIS OF NORTH DAKOTA LIGNITE | |
|---|---|
| Moisture, W % | 37.9 |
| Volatile Matter, W % | 26.7 |
| Fixed Carbon, W % | 29.2 |
| Ash, W % | 6.2 |
| | 100.0 |

The representative drying curve was obtained as shown by FIG. 3. It is noted that initial drying to remove surface moisture occurs rapidly down to a critical moisture range of 8–11 weight percent moisture, within which range further moisture removal occurs at a slower rate. Below about 8 weight percent moisture content the lignite drying at constant air circulation rate again proceeds at a more rapid rate, apparently due to surface rupture of the lignite particles to liberate bound internal moisture.

EXAMPLE 2

A further test method was developed to determine the critical moisture content or range below which heating and spontaneous ignition of the dried lignite was likely to occur. The apparatus used is shown in FIG. 4 and consisted of a perforated pint size metal container suspended within a gallon size metal container. The dried lignite was placed into the perforated inner container with water in the outer container, and the assembly was heated to about 160° F. while resting on an electric hot plate. The temperatures of the water liquid, vapor, and the lignite were monitored by thermocouples. A rise in temperature or an exotherm of the lignite to above the water temperature was taken to indicate that reaction and reheating of the lignite by reabsorption of moisture was taking place.

Results from this test method for determining reabsorption of moisture by the dried lignite samples are provided in Table 2.

TABLE 2

| Run No. 1: Moisture in Dried Sample - 24.8 W % | | | | |
|---|---|---|---|---|
| Elapsed Time, Hrs. | 1 | 2 | 3 | 4 |
| Temperature, Water, °F. | 121 | 149 | 153 | 153 |
| Temperature Vapor, °F. | 108 | 136 | 142 | 142 |
| Temperature Lignite, °F. | 66 | 130 | 138 | 141 |
| No exotherm observed for lignite sample after drying for four hours. | | | | |
| Run No. 2: Moisture in Dried Sample - 10.8 W % | | | | |
| Elapsed Time, Hrs | 1 | 2 | 3 | 4 |
| Temperature Water, °F. | 158 | 165 | 166 | 165 |
| Temperature Vapor, °F. | 156 | 158 | 158 | 156 |
| Temperature Lignite, °F. | 116 | 163 | 165 | 163 |
| No lignite exotherm observed after four hours of drying. | | | | |
| Run No. 3: Moisture in Dried Sample - 9.5 W % | | | | |
| Elapsed Time, Hrs. | 1 | 2 | 3 | 4 |
| Temperature Water, °F. | 164 | 166 | 165 | 169 |
| Temperature Vapor, °F. | 154 | 158 | 160 | 160 |
| Temperature Lignite, °F. | 136 | 158 | 160 | 160 |
| No exotherm was observed after four hours drying. | | | | |
| Run No. 4: Moisture in Dried Sample - 6.3 W % | | | | |
| Elapsed Time, Hrs. | 1 | 2 | 3 | 4 |
| Temperature Water, °F. | 144 | 163 | 166 | 166 |
| Temperature Vapor, °F. | 135 | 157 | 158 | 158 |
| Temperature Lignite, °F. | 89 | 161 | 189 | 182 |
| Lignite exotherm of 16–23° F. occurred at 3–4 hours drying time. | | | | |
| Run No. 5: Moisture in Dried Sample - 4.4 W % | | | | |
| Elapsed Time, Hrs. | 1 | 2.5 | 3 | 4 |
| Temperature Water, °F. | 151 | 173 | 174 | 175 |
| Temperature Vapor, °F. | 142 | 163 | 164 | 164 |
| Temperature Lignite, °F. | 112 | 174 | 178 | 180 |
| Lignite exotherm was 5° F. after four hours drying. | | | | |

These data show that above about 9.5 weight percent water remaining in the dried lignite samples, the lignite is stable and does not reheat or spontaneously ignite when reexposed to moisture vapor conditions. However, below about 8 weight percent moisture, in which particles surface rupture usually occurs as shown in the FIG. 3 drying curve, reheating and reaction or spontaneous ignition of dried lignite will occur when it is reexposed to a moist atmosphere. Thus, these data support the basic premise of this invention and Example 1, that following the removal of the free moisture from the coal or lignite by rapid drying processes, the remaining bound of chemisorbed moisture is usually erupted from the lignite during further drying, thereby leading to a porous high surface area material which is subject to reabsorption of moisture, reheating and spontaneous ignition. However, by control of the vapor pressure differential at particle moisture contents below a critical range of about 8–11 weight percent moisture by providing slow drying rates in accordance with this invention, rupture of the lignite particles are not only avoided, but tars contained in the lignite are wicked out to the particle surface and seal the particle pores sufficiently to prevent further significant absorption of moisture.

Therefore, contrary to the teachings of the prior art, the controlled drying of lignite or similar carbonaceous materials having initial moisture contents exceeding about 10 weight percent, and usually 15–50 weight percent, should be performed at low moisture removal rates below a critical moisture range of 8–12 weight percent, following an initial drying step of removal of the surface moisture at higher drying rates.

EXAMPLE 3

Lignite containing as-mined moisture, greater than about 15 weight percent moisture, is first dried in a material conveying type dryer similar to FIG. 1 by direct contact with low humidity air containing about 0.01 lbs $H_2O$/lb air at 250°–300° F. and at a drying rate to remove the free or surface water down to a critical moisture content of 8–12 weight percent. This partially dried lignite may be cooled and removed from the dryer and used (burned) as-is, but a portion is passed into a second drying zone maintained at or about 220° F. by steam injection to control the wet bulb temperature and humidity at above 160° F. and 0.08 lbs $H_2O$ vapor/lb dry air, respectively. Such further drying at a controlled slower rate yields a cured firm lignite particle having surfaces impervious to the reabsorption of sufficient moisture to cause reheating and spontaneous ignition, and with a particle moisture content in the range of about 3–8 weight percent.

EXAMPLE 4

Lignite with as-mined moisture content of at least 15 weight percent is fed to a dryer similar to FIG. 2 wherein the free or surface moisture is removed by indirect heat transfer from heated wall surfaces at atmospheric pressure. The remaining chemically-bound moisture is then removed from the lignite by passing it thru a second drying vessel or zone held at elevated pressure of 5 psig and 250° F. temperature, and with a controlled gas vent rate so as to maintain the wet bulb temperature at about 160° F. The residence time is controlled to yield an integral lignite particle having less than about 5 weight percent moisture and not subject to reheating and spontaneous ignition upon reexposure to moist air. Drying conditions used will vary depending on the lignite, coal or carbonaceous material used, and must be adjusted to control the rate of moisture removal below the critical moisture level to be slow enough to prevent rupture of the particle surface and also permit self-sealing the particle pores by internal hydrocarbon materials, such as tars being evolved to the surface.

Although the invention has been described in terms of the accompanying diagram and preferred embodiments, it will be appreciated by those skilled in the art that many modifications and adaptations of the basic process are possible within the spirit and scope of the invention, which is defined only by the following claims.

I claim:

1. A method for drying carbonaceous material containing at least about 10 weight percent moisture, wherein the material is first heated to at least about 150° F. under conditions of water vapor differential partial pressure exceeding about 8 psi while reducing moisture content of the material to not less than about 8 weight percent, then continuing heating the material at water vapor differential pressure less than about 8 psi to provide slower drying rate and to permit evolution of internal hydrocarbon material to self seal the particle surface with said hydrocarbon material, such that the reabsorption of atmospheric moisture and consequent reheating of the dried product is substantially prevented.

2. The method of claim 1 in which the carbonaceous material being dried is sub-bituminous coal containing 15–50 weight percent moisture.

3. A process for continuously drying particulate solid carbonaceous material containing at least about 10 weight percent moisture, comprising the steps of:

(a) introducing the material into a first compartment maintained at about atmospheric pressure and heating it to at least about 150° F. to remove surface moisture at a drying rate for achieving initial surface drying:

(b) passing the partially dried material into a second compartment maintained at lower water vapor differential pressure to remove remaining bound moisture from the material at a slower drying rate so as to permit evolution of internal hydrocarbon material to self seal particle surface pores with said internal hydrocarbon material; and (c) removing the dried carbonaceous material as product.

4. The process of claim 3 wherein the carbonaceous material is lignite containing 15–50 weight percent moisture.

5. The process of claim 3 wherein the carbonaceous material is heated by moist air and is moved through each drying step by moving belt means.

6. The process of claim 3 wherein the carbonaceous material is moved through each drying step by screw conveyor means, and the material is heated indirectly by contact with heated wall surfaces.

7. A process for drying of carbonaceous material containing at least about 10 weight percent moisture comprising drying the material to achieve a critical moisture content range of 8–12 weight percent, then further drying the material to below the critical moisture content at a slower controlled drying rate under controlled moisture conditions.

8. The process of claim 7 wherein the carbonaceous material contains 15–50 weight percent moisture.

9. The process of claim 7 wherein the carbonaceous material is low rank coal which is dried by hot gas in a fluidized bed.

10. The process of claim 7 wherein the carbonaceous material is lignite which is dried by circulating air in a heated oven.

* * * * *